US006865752B2

(12) United States Patent
Udelhofen et al.

(10) Patent No.: US 6,865,752 B2
(45) Date of Patent: Mar. 15, 2005

(54) ADJUSTABLE SPORTS HELMET

(75) Inventors: Patrick Udelhofen, Chicago, IL (US); Douglas G. Guenther, Wheaton, IL (US); Cory R. Boudreau, Madison, WI (US)

(73) Assignee: Wilson Sporting Goods Co., Chicago, IL (US)

( * ) Notice: Subject to any disclaimer, the term of this patent is extended or adjusted under 35 U.S.C. 154(b) by 59 days.

(21) Appl. No.: 10/327,759

(22) Filed: Dec. 23, 2002

(65) Prior Publication Data

US 2004/0117897 A1 Jun. 24, 2004

(51) Int. Cl.[7] ..... A63B 71/10
(52) U.S. Cl. ..... 2/425; 2/418; 2/421
(58) Field of Search ..... 2/425, 421, 417, 2/418, 419, 420, 416, 414, 415, 183

(56) References Cited

U.S. PATENT DOCUMENTS

| | | | | | |
|---|---|---|---|---|---|
| 2,698,434 | A | * | 1/1955 | Davia | 2/415 |
| 3,028,602 | A | * | 4/1962 | Miller | 2/6.1 |
| 3,055,013 | A | * | 9/1962 | Aileo | 2/414 |
| 3,329,968 | A | * | 7/1967 | Gordon | 2/418 |
| 3,479,666 | A | * | 11/1969 | Webb | 2/6.6 |
| 3,633,214 | A | * | 1/1972 | Newcomb | 2/418 |
| 3,696,440 | A | * | 10/1972 | Littleton | 2/418 |
| 3,787,894 | A | * | 1/1974 | Goodman, Jr. | 2/418 |
| 3,991,423 | A | * | 11/1976 | Jones | 2/415 |
| 5,042,093 | A | * | 8/1991 | Legendre | 2/419 |
| 5,175,889 | A | * | 1/1993 | Infusino | 2/413 |
| RE34,699 | E | * | 8/1994 | Copeland et al. | 2/419 |
| 5,337,420 | A | | 8/1994 | Haysom et al. | 2/410 |
| 5,477,565 | A | * | 12/1995 | Hunt, Jr. | 2/423 |
| 5,511,250 | A | | 4/1996 | Field et al. | 2/418 |
| 5,575,017 | A | | 11/1996 | Hefling et al. | 2/418 |
| 5,619,754 | A | * | 4/1997 | Thurwanger et al. | 2/418 |
| 5,694,649 | A | | 12/1997 | Hefling et al. | 2/418 |
| 5,815,847 | A | * | 10/1998 | Holden, Jr. | 2/418 |
| 5,918,316 | A | * | 7/1999 | Nathanson et al. | 2/209.13 |
| 5,974,593 | A | | 11/1999 | McNabb | 2/418 |
| 6,256,798 | B1 | | 7/2001 | Egolf et al. | 2/421 |
| 6,505,426 | B2 | * | 1/2003 | Yang | 40/315 |
| 6,665,884 | B1 | * | 12/2003 | Demps et al. | 2/414 |

* cited by examiner

*Primary Examiner*—Rodney M. Lindsey
(74) *Attorney, Agent, or Firm*—Terence P. O'Brien

(57) ABSTRACT

An adjustable sports helmet configured for protecting a user's head. The helmet includes a shell, a padding assembly and an adjustment assembly. The shell has an inner surface and an outer surface. The padding assembly is coupled to the inner surface of the shell. The padding assembly has at least two spaced apart adjustment points. The adjustment assembly includes a guide, a strap and at least one adjusting member. The guide is operably coupled to the inner surface of the shell. The strap has a first portion connected to the guide and a second portion releasably connected to the outer surface of the helmet. The adjusting member is operably engaged to the guide and is connected to the adjustment points of the padding assembly.

41 Claims, 10 Drawing Sheets

ADJUSTABLE SPORTS HELMET

FIELD OF THE INVENTION

The present invention relates generally to a sports helmet. In particular, the present invention relates to an adjustable sports helmet having a padding assembly and an adjustment assembly that enables the user to quickly and easily selectably adjust the padding assembly to fit the user's head.

BACKGROUND OF THE INVENTION

Sports helmets, such as batting, bicycle, hockey, football, lacrosse, and motorcycle helmets, are well known and typically include a shell having inner and outer surfaces and a padding assembly connected to the inner surface of the shell. Batting helmets, in particular, also typically include a bill and one or two ear protecting portions extending from the shell. Many sport helmets also typically include corresponding face masks. Additionally, many existing sports helmets also can include a mechanism for adjusting the size of the padding assembly within the helmet to enable the helmet to adapt to fit different users having different head sizes.

Many sports helmet, and in particular batting helmets, are commonly shared by several players, and often an entire team, during the course of a game. Often the batting helmets are shared from one batter to the next or from one baserunner to a batter. In such situations, the batter often must quickly place the helmet onto his or her head as he or she is approaching the batter's box. Because the size of the player's heads can vary, teams often either have several fixed sized helmets of different sizes or a smaller number of adjustable helmets. Such adjustable helmets must be capable of being quickly, easily and securely positioned onto the player's head, preferably by the player alone without assistance from others.

Existing adjustable helmets have a number of drawbacks. Existing adjustable helmets include adjustment mechanisms that are difficult and time-consuming to adjust. Many adjustable helmets have an adjustment mechanism, which is positioned entirely adjacent to the inner surface of the shell of the helmet, thereby requiring the user to remove the helmet in order to properly perform a size adjustment, or requiring a second person to assist the user with the adjustment. Other adjustable helmets are configured for adjustment while positioned on the user's head. However, these adjustable helmets typically require two hands to perform the adjustment as well as a separate hand to maintain the helmet secured on the user's head during the adjustment. As a result, two people are generally required to properly adjust such helmets. It is possible to adjust such helmets with just two hands however both hands must be used to operate the adjustment mechanism and therefore the user must be very cautious in order to prevent the helmet from becoming dislodged from the user's head during the adjustment. Such helmets are especially difficult for young players to adjust by themselves. Moreover, many existing adjustment mechanisms, which include a portion of the adjustment mechanism outside of the shell of the helmet have an undesirable and awkward appearance. Other such adjustment mechanisms outside of the shell of the helmet are bulky and/or heavy thereby making the helmet uncomfortable to wear and making the helmet more susceptible to becoming dislodged from the user's head.

Additionally, existing batting helmets typically have a single glossy, smooth outer surface. Such outer surfaces can become slippery, particularly when wet, and as a result can be difficult for the user to hold when not wearing, or manipulating the helmet.

Thus, there is a continuing need for an adjustable sports helmet that can be easily, quickly and reliably adjusted by the user, particularly young users, without having to remove the helmet from the user's head. What is also needed is a helmet that requires only one hand to operate the adjustment mechanism, thereby enabling the helmet to be easily adjusted with a single hand or with two hands. It would be advantageous to provide an adjustable sports helmet with an adjustment mechanism that is accessible from outside of the shell of the helmet and does not result in a bulky, unattractive appearance. There is also a need for an adjustment mechanism for a sports helmet that is easy to use and does not significantly increase the weight of the helmet. What is also needed is a helmet that can be easily, reliably and selectably adjusted to fit a variety of different users. Further, it would be advantageous to provide a batting helmet with an outer surface that is not entirely formed of a smooth glossy surface. It would be desirable to produce a batting helmet with a unique desirable appearance.

SUMMARY OF THE INVENTION

The present invention provides an adjustable sports helmet configured for protecting a user's head. The helmet includes a shell, a padding assembly and an adjustment assembly. The shell has an inner surface and an outer surface. The padding assembly is coupled to the inner surface of the shell. The padding assembly has at least two spaced apart adjustment points. The adjustment assembly includes a guide, a strap and at least one adjusting member. The guide is operably coupled to the inner surface of the shell. The strap has a first portion connected to the guide and a second portion releasably connected to the outer surface of the helmet. The adjusting member is operably engaged to the guide and is connected to the adjustment points of the padding assembly.

According to a principal aspect of the invention, an adjustable batting helmet configured for protecting a batter's head includes a shell, a padding assembly, and an adjustment assembly. The shell has an inner surface and an outer surface. The shell includes a through-wall slot. The padding assembly is coupled to the inner surface of the shell. The adjustment assembly is operably connected to the padding assembly, and includes a strap. The strap extends from the adjustment assembly through the slot and releasably connects to the outer surface of the shell in a non-overlapping manner. The strap is configured for grasping by the batter and to enable the batter to adjust the padding assembly within the shell.

According to another preferred aspect of the invention an adjustable batting helmet configured for protecting a batter's head includes a shell, a padding assembly, an adjustment assembly, and an actuator. The shell has an inner surface and an outer surface, and includes an aperture. The padding assembly is coupled to the inner surface of the shell. The padding assembly is configured to generally conform to the batter's head. The padding assembly has at least first and second spaced apart adjustment points. The adjustment assembly is positioned within the shell and connects to the padding at the first and second spaced apart adjustment points. The actuator extends through the aperture of the shell and has first and second portions. The first portion is operably connected to the adjustment assembly within the shell and a second portion is positionable from the outer surface of the shell to selectably adjust the padding assembly.

According to yet another preferred aspect of the invention, a batting helmet configured for protecting a batter's head includes a shell and a padding assembly. The shell has inner and outer surfaces. The outer surface of the helmet has first and second regions. The first region has a generally smooth texture and the second region has a slightly roughened texture. The padding assembly is coupled to the shell.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
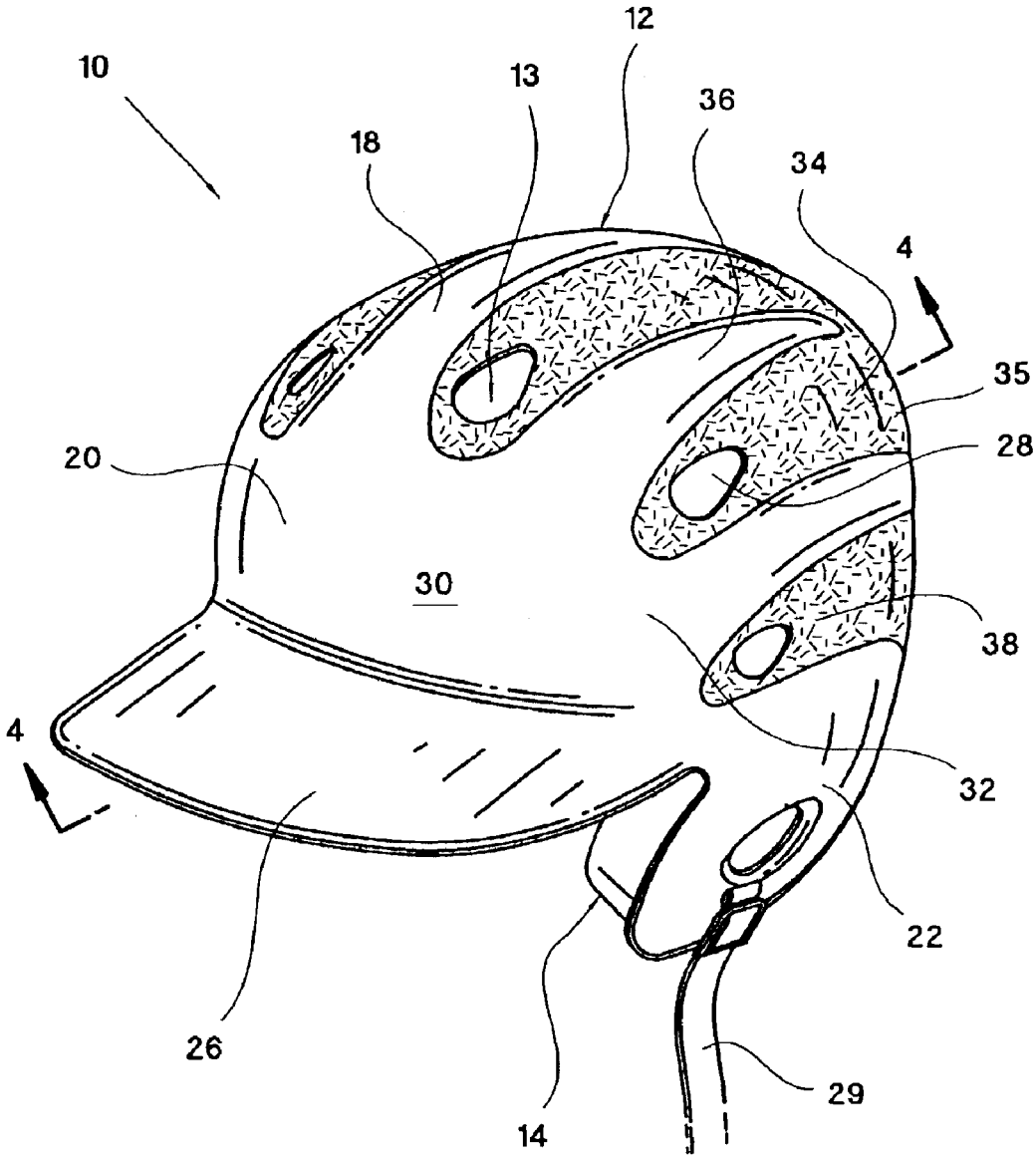
FIG. 1 is a front perspective view of a helmet in accordance with a preferred embodiment of the present invention.
Figure 2:
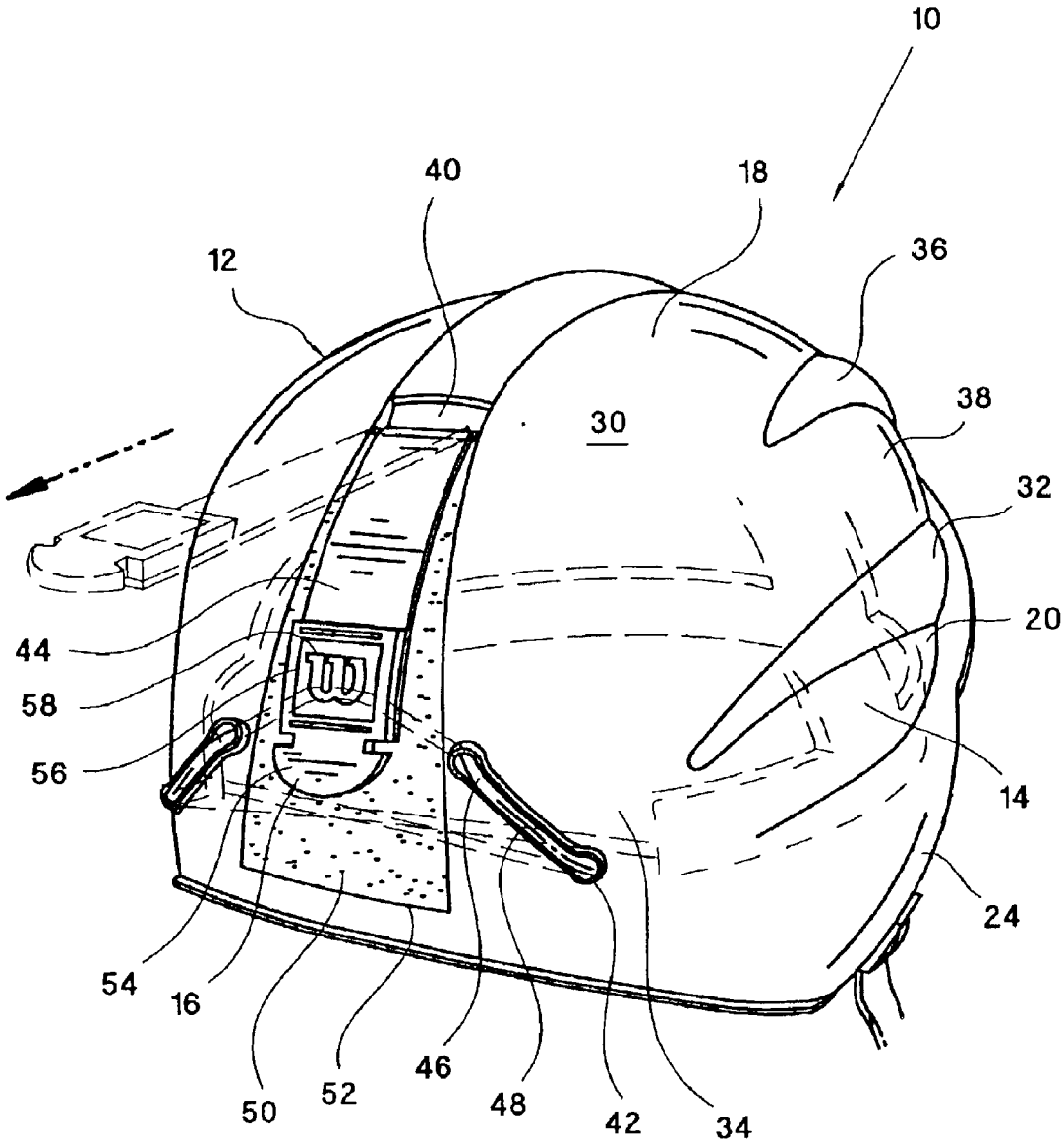
FIG. 2 is a rear perspective view of the helmet of FIG. 1, wherein an adjusting strap in a released position and a padding assembly are shown in phantom lines.

Referring to FIGS. 1 and 2, a batting helmet is indicated generally at 10. The helmet 10 of FIG. 1 is configured as a batting helmet, however, the invention can also be formed as other types of sports helmets, such as, for example, a football helmet, a hockey helmet, a lacrosse helmet, a bicycle helmet and a motorcycle helmet. The helmet 10 is configured to meet National Operating Committee on Standards for Athletic Equipment ("NOCSAE") as required by the National Collegiate Athletic Association ("NCAA"), the National Federation of State High School Associations and youth organizations. The helmet includes a shell 12, a padding assembly 14 (or head support assembly) and an adjustment assembly 16.

The shell 12 is a generally hemisperically shaped head covering, which forms a cranial cavity 13, configured to loosely cover and protect the upper portion of a user's head. The shell 12 has a dome-like crown 18, a generally continuous circumferential side wall 20, first and second ear protective regions 22 and 24, and a bill 26. Preferably, the crown 18, side wall 20, first and second ear protective regions 22 and 24, and the bill 26 are integrally formed to one another. In alternative preferred embodiments, one or more of these shell 12 regions can be connected together in a non-integral manner. The shell 12 is formed of a rigid, durable material, preferably, acrylonitrile-butadiene-styrene ("ABS"). In alternative preferred embodiments, the shell 12 can be formed of other materials, such as, for example, a polycarbonate, plastic, aluminum, or other polymers. The shell 12 is configured to protect the user's head by resisting, absorbing and distributing impact loads, such as, for example, the impact from a pitched ball, thereby reducing the load transferred to or felt by the user due to an impact.

The shell 12 further preferably includes a plurality of ventilation holes 28 for enabling air to flow into and out of the helmet 10. In a particularly preferred embodiment, four ventilation holes 28 are spaced apart across a front portion of the shell 12. Each ventilation hole 28 having a general tear drop shape. In alternative preferred embodiments, the shell 12 can include a different number of ventilation holes in a variety of different shapes, or the shell 12 can be absent of ventilation holes. The shell 12 also preferably includes a chin strap 29 for attachment to the ear protective regions 22 and 24 or the shell 12. The chin strap 29 further secures the helmet to the user's head.

The shell 12 includes an outer surface 30 having a unique two piece alternating rib and finger pattern including first and second regions 32 and 34. The first region 32 of the outer surface 30 is slightly raised with respect to the second region 34 and includes a polished glossy finish or texture. The first region 32 covers the front portion of the side wall 20 and includes a plurality of curved elongated raised ribs 36 extending from the front portion of the side wall 20 rearward over the crown 18 and the side portions of the side wall 20. The second region 34 of the two-piece pattern of the outer surface 30 of the shell 12 is not raised with respect to the first region 32 and includes a slightly roughened, non-glossy finish or texture 35. The second region 34 substantially covers the rear portion of the side wall 20 includes forwardly extending elongate fingers 38 that engage the ribs 36 in an alternating fashion to cover the remaining portion of the crown 18 and the side wall 20. The ribs 36 further strengthen the shell 12. Preferably, one of the ventilation holes 28 is positioned at each of the fingers 38. This two-piece pattern formed by the first and second regions 32 and 34 provides the shell 12 with a unique aesthetic appearance. In alternative preferred embodiments, the outer surface 30 of the shell 12 can include other raised and non-raised shapes, and other combinations of shapes and patterns. Further, the surface finish of the outer surface 30 can be entirely glossy, semi-glossy or non-glossy, or can include other variations or combinations of these finishes.

In alternative preferred embodiments, the helmet 10 can be formed in any variety of shapes and can include raised or non-raised portions wherein the outer surface of the shell includes the first region having a first generally smooth texture and the second region having a second generally slightly roughened or non-glossy texture. The slightly roughened texture of the second region of the shell can make the helmet 10 easier to grasp and otherwise manipulate, particularly if the user's hand or the helmet is wet.

Moreover, the smooth texture of the first region and the slightly roughened texture of the second region alone provide the helmet 10 with a unique desirable appearance. In a particularly preferred embodiment, each of the first and second regions extend over at least 20 percent of the surface area of the outer surface 30 of the shell 12.

Referring to FIG. 2, the rear portion of the shell 12 includes an adjusting member slot 40 and a plurality of support holes 42. The slot 40 is configured for receiving an adjusting strap 44. The slot 40 is preferably generally rectangular and is positioned at a central portion of the rear portion of the shell 12. The support holes 42 are configured to provide a slidably support for an adjusting member 46. In a preferred embodiment, the shell 12 includes two pairs of support holes 42 and a groove 48 is defined within the outer surface 30 of the shell 12 between each pair of the support holes 42 for further supporting and operably guiding the adjusting member 46. In alternative preferred embodiments, the slot 40 and the support holes 42 can be positioned in other positions about the shell 12 and can be formed in other shapes, such as, for example, oval, circular, tear-drop, polygonal and irregular.

The rear portion of the helmet 10 further includes a fastener for releasably connecting to the adjusting strap 44 to the shell 12. In a preferred embodiment, the fastener is a hook and loop type fastener wherein an elongate patch 50 formed of loop type fastening material is connected to the rear portion of the helmet 10. The patch 50 is configured to releasably connect with corresponding hook fastening material connected to a portion of the strap 44. In a particularly preferred embodiment, a trapezoidal recess 52 is formed within the rear portion of the shell 12 below the slot 40 and the patch 50 is advantageously sized to substantially fill the recess 52. The patch 50 is sufficiently sized to provide a large area for releasable attachment of the hook fastening material of the strap 44. The size of the patch 50 enables the hook fastening material of the strap 44 to be releasably connected to patch 50 in a large number of positions thereby providing a large number of adjustment positions. The patch 50 is preferably adhesively bonded to the shell 12 at the recess 52. Alternatively, the patch 50 can be attached to the shell 12 through other means such as, for example, thermal bonding, press-fit connection, stitching and combinations thereof. The loop-type fastening material of the patch 50 quickly and securely connects to the corresponding patch of hook material. The loop type material provides a felt-like feel that is smooth to the touch and thus won't irritate users or other individuals who contact the material. In alternative preferred embodiments, the patch 50 and hook type material of the strap 44 can be replaced with another releasable fasteners, such as, for example, one or more buckles, snaps, buttons, resilient connectors, press-fit connectors and combinations thereof.

The adjusting strap 44 is a flexible actuator configured to releasably and adjustably connect to the patch 50 of the shell 12. The strap 44 preferably includes a tab 54 for facilitating the manipulation of the strap 44 with respect to the shell 12, in particular with the connection and release of the strap 44 to and from the shell 12. The tab 54 also facilitates grasping of the strap 44 by the user. In a preferred embodiment, the tab 54 includes an outer surface 56 and indicia 58 placed on the outer surface 56 of the tab 54. The indicia 58 can be graphical indicia, alphanumeric indicia or combinations thereof. The indicia 58 can include source indicators, trademarks, instructions for use, product identifiers, warning labels are any related item.

Figure 3:
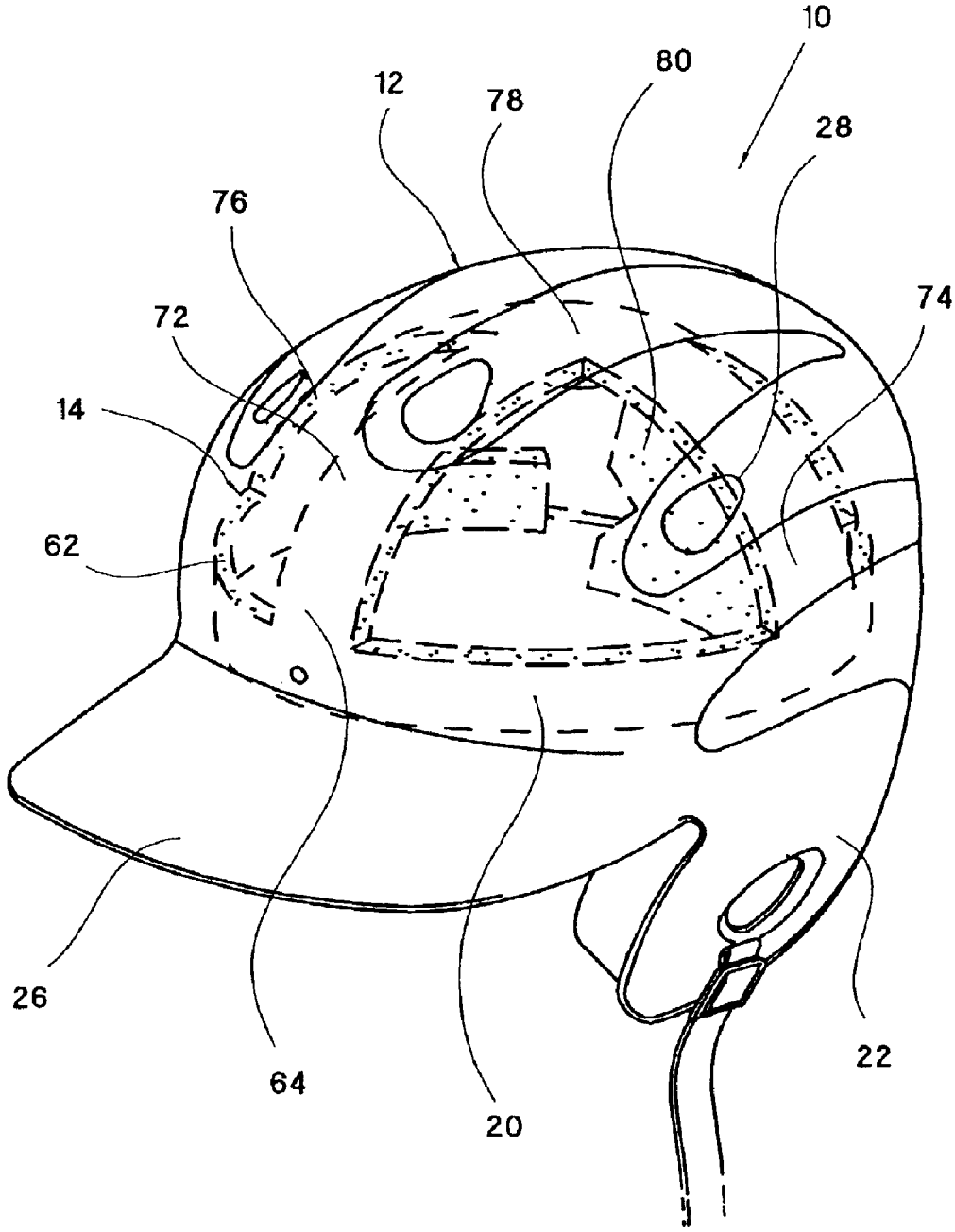
FIG. 3 is a front perspective view of the helmet of FIG. 1 with the padding assembly shown in phantom lines.
Figure 4:
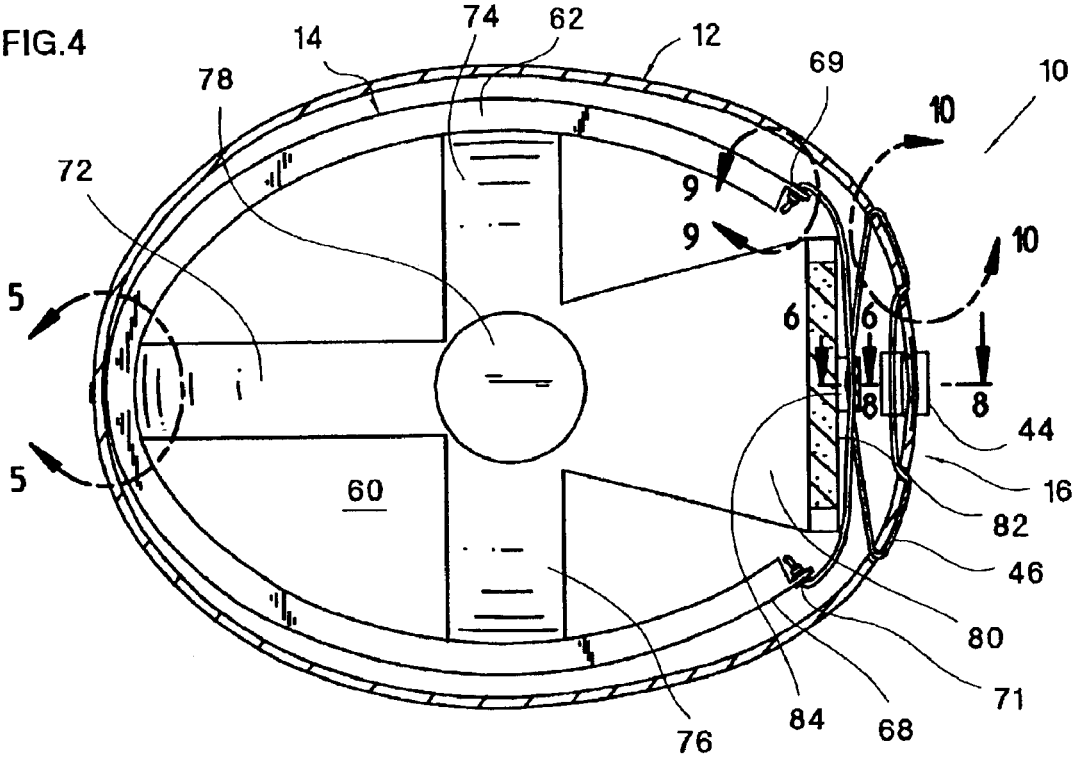
FIG. 4 is a bottom cross-sectional view of the helmet taken along line 4—4 of FIG. 1 with the padding assembly in an enlarged position and an adjustment assembly in a secured position.

Referring to FIGS. 3 and 4, the padding assembly 14 of the helmet 10 is shown in greater detail. The padding assembly 14 includes a plurality of support members configured to dampen, reduce, absorb and/or dissipate shock resulting impact of the helmet with an object, and reduce the shock transferred to, or felt by, the user due to an impact. The padding assembly 14 is positioned within the shell 12 near or adjacent to an inner surface 60 of the shell 12. The padding assembly 14 is coupled to the shell 12 at at least one location. In one preferred embodiment, the padding assembly 14 includes a generally circumferential portion 62, which extends along the inner surface 60 at the front and side portions of the side wall 20 of the shell 12.

Figure 5:
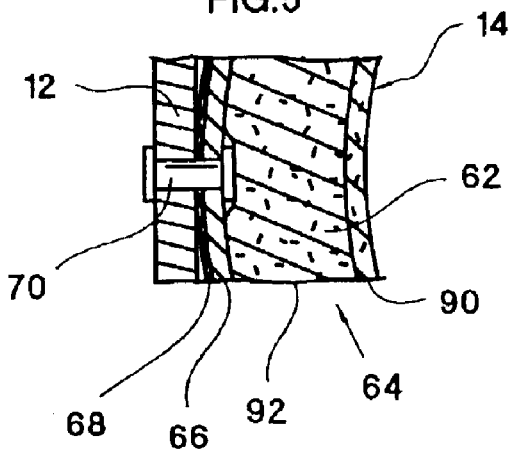
FIG. 5 is a bottom sectional view of the front portion of the helmet taken along line 5—5 of FIG. 4.

Referring to FIG. 4, the circumferential portion 62 typically contacts the inner surface 60 at the front portion of the shell 12, while the remaining regions of the circumferential portion 62 are generally slightly spaced apart from the shell 12. Referring to FIGS. 4 and 5, the padding assembly 14 is shown in greater detail. The circumferential portion 62 of the padding assembly 14 is a multi-layered structure having a circumferential padding layer 64, a reinforcing member 66 and a band 68. The reinforcing member 66 is a strip of generally flexible support material, such as for example, a plastic, which provides additional stiffness to the circumferential portion 62. The padding layer 64 is mounted to the inner surface of the reinforcing member 66. The first and second ends of the reinforcing member 66 include first and second adjustment points 69 and 71, respectively, which connect to the adjusting member 46 of the adjustment assembly 16. The band 68 is an elastic member that extends around and preferably bears against, and connects to, the outer surface of the reinforcing member 66. The band 68 has first and second ends positioned at the rearmost positions of each side of the circumferential portion 62. The reinforcing member 66 and the band 68 provide additional support to the circumferential layer 62 and provides a means of evenly adjusting the circumferential opening formed by the circumferential layer 62. The reinforcing member 66 and the band 68 enable the circumferential portion 62 to maintain a consistent curved shape as it is adjusted. In alternative preferred embodiments, the circumferential portion 62 can be formed of a single padded structure or other multi-layered constructions which generally circumferentially contact the user's head during use.

In a particularly preferred embodiment, the padding assembly 14 is connected to the shell 12 using a first rivet 70. The first rivet 70 extends through the shell 12 and partially through the circumferential portion 62 of the padding assembly 14. The first rivet 70 secures the padding assembly 14 to the shell 12 and maintains the front portion of the padding assembly in contact with the shell 12. Accordingly, as the padding assembly 14 is adjusted, the front portion of the padding assembly 14 remains generally fixed in relation to the shell 12. Other conventional fastening means can also be used in lieu of the first rivet 70.

Referring to FIGS. 3 and 4, the padding assembly 14 further includes a curved front portion 72 and first and second curved side portions 74 and 76. Each of the front portion 72 and the first and second side portions 74 and 76 connect to and upwardly extend from the circumferential portion 62. The front portion 72 and the first and second side portions 74 and 76 then upwardly extend along the inner surface 60 of the shell 12 and connect to each other at a top portion 78 along the inner surface 60 of shell 12 below the crown 18. The front portion 72, and the first and second side portions 74 and 76 can contact, or be slightly spaced apart from, the shell 12. In a preferred embodiment, the top portion 78 of the padding assembly 14 is also connected to the shell 12. In one preferred embodiment, the top portion 78 of the padding assembly 14 is connected with a hook and loop type fastener to the inner surface 60 of the shell 12. In alternative preferred embodiments, the top portion of the padding assembly can be connected to the shell using a rivet or other conventional type fastener.

Figure 6:
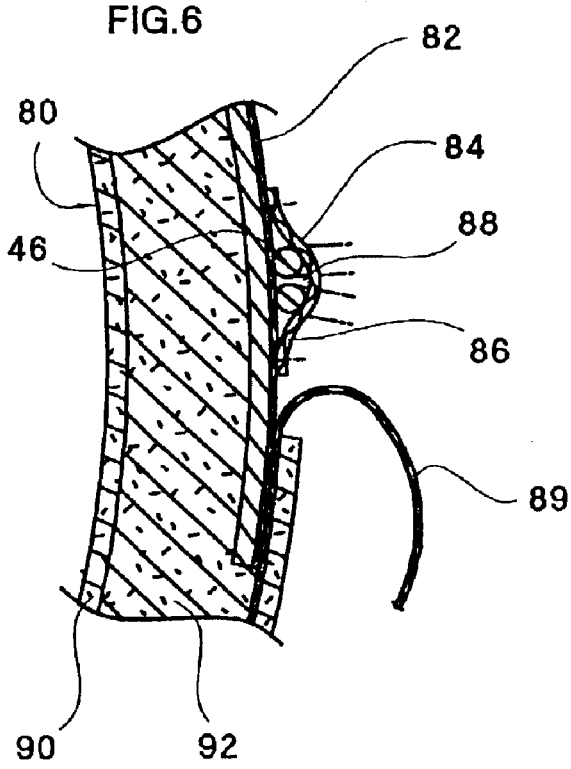
FIG. 6 is a side, sectional view of the back portion of the padding assembly of the helmet taken along line 6—6 of FIG. 4.

The padding assembly 14 also preferably includes a back portion 80 that downwardly and rearwardly extends from top portion 78. The back portion 80 of the padding assembly 14 generally extends over the rear region of the shell 12. The back portion 80 is preferably spaced apart from the shell 12, but can contact the shell 12 at some locations. Referring to FIGS. 4 and 6, the back portion 80 of the padding assembly 14 has an outer rear surface 82 and a third adjustment point 84 is positioned on the outer rear surface 82 of the back portion 80. Preferably the third adjustment point 84 is a segment 86 of material attached at its top and bottom edges to the outer rear surface 82 of the back portion 80. The segment 86 forms a padding channel 88 for receiving the adjusting member 46. The back portion of the padding assembly 14 also preferably includes a flap 89 outwardly extending from the outer rear surface 82. The flap 89 is flexible sheet which can extend across to the rear of the shell 12 to generally cover the lower portion of the adjustment assembly 16.

The padding assembly 14 is configured to form an adjustably sized opening for generally receiving the top of the user's head. The padding assembly 14 provides a lightweight, comfortable, durable and shock-absorbing interface between the user and the shell 12 of the helmet 10. Referring to FIGS. 5 and 6, each portion of the padding assembly 14 is preferably formed of a dual density, two-layer padding structure, a inner padding layer 90 and a outer padding layer 92. The inner and outer padding layers 90 and 92 are formed of a lightweight, cushionable, resilient material, preferably a foam material formed of ethyl vinyl acetate ("EVA foam"). The inner padding layer 90 is configured to directly contact the user's head during use and preferably is formed of a softer padding material having a lower density than the outer padding layer 92. The higher density outer padding layer 92 increases the stability of the padding assembly 14.

In alternative preferred embodiments, the inner and outer padding layers 90 and 92 can be formed of open or closed cellular or non-cellular foam, a gel, a fluid filled bladder, a plurality of spherical balls, a plurality of other geometric objects, or an air filled bladder. In other alternative preferred embodiments, the padding assembly 14 can be formed of other single or multi-layered padding constructions. The padding assembly 14 can also include any combination of front, rear, side and top portions. The padding assembly 14 can be generally continuous and substantially cover the inner surface 60 of the shell 12 or the padding assembly 14 can be configured with spaced-apart portions in any number of configurations provided that the padding assembly 14 protects the user's head from impact loads. In another alternative preferred embodiment, the padding assembly can include 2, 3, 4 or more adjustment points coupled to the adjustment assembly to achieve adjustment of the helmet.

Figure 7:
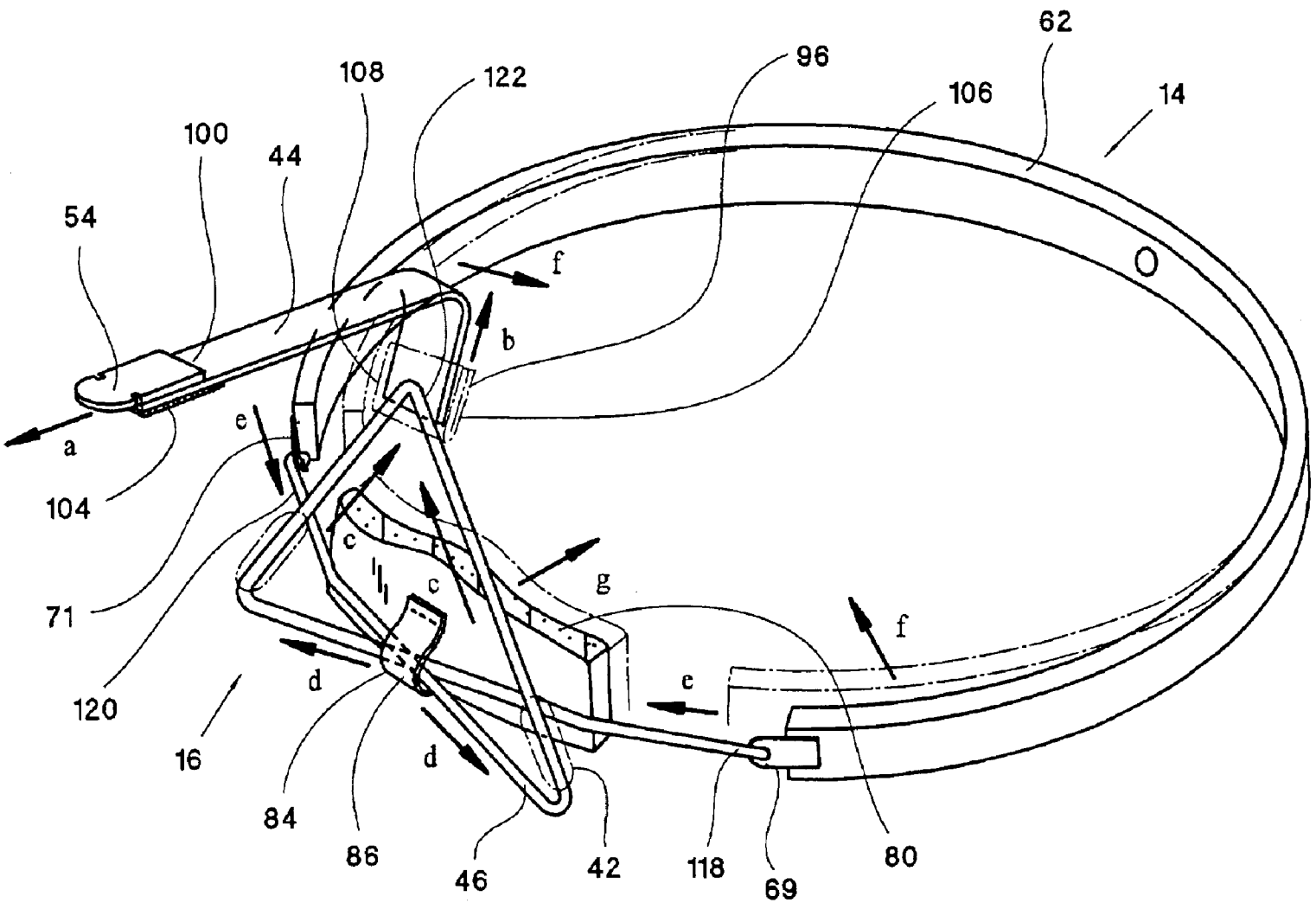
FIG. 7 is a rear perspective view of a portion of the padding assembly and the adjustment assembly of the helmet of FIG. 1
Figure 8:
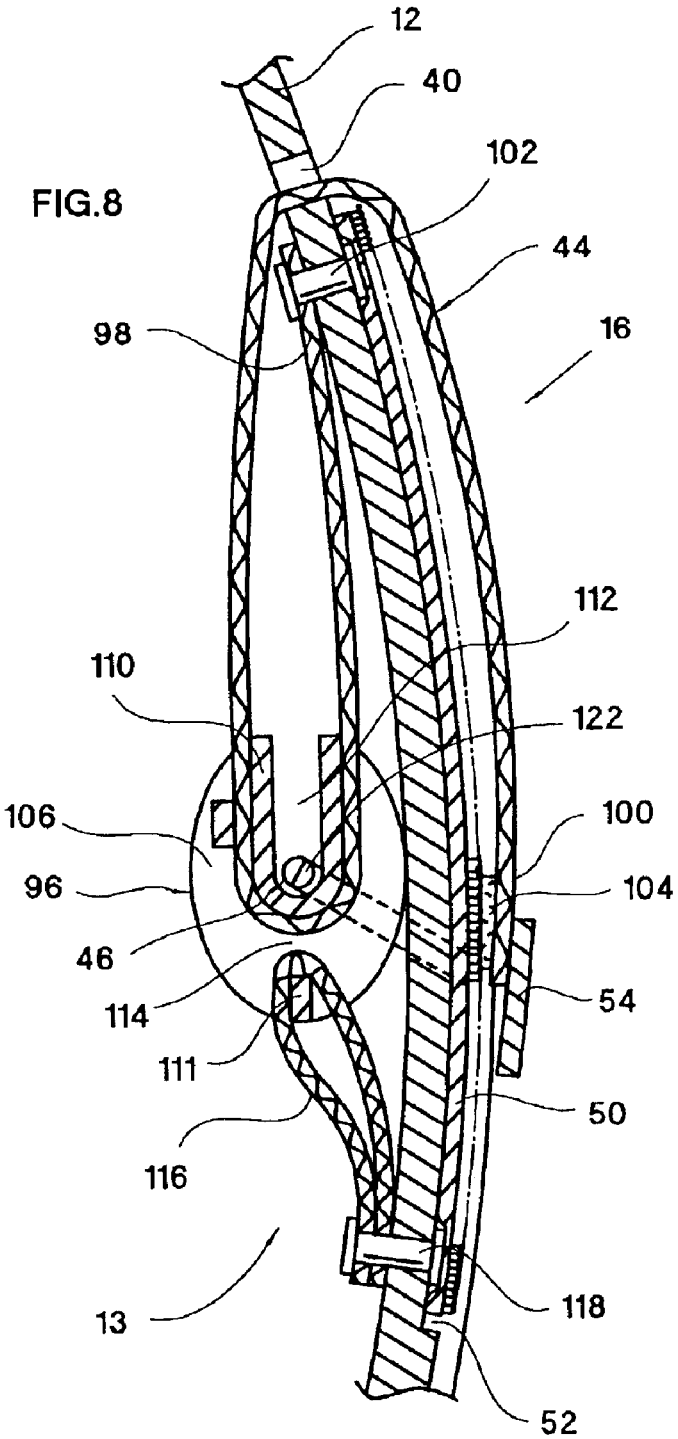
FIG. 8 is side sectional view of a rear section of the helmet taken along line 8—8 of FIG. 4.

Referring to FIGS. 7 and 8, the adjustment assembly 16 is shown in greater detail. The adjustment assembly 16 includes the adjusting strap 44, a guide 96 and the adjusting member 46. The adjusting assembly 16 is connected to the rear of the padding assembly 14 and, excluding a portions of the strap 44 and the adjusting member 46, is generally disposed within the cavity 13 formed by the shell 12. The adjustment assembly 16 enables the size of the opening formed by padding assembly 14 to be readily, quickly and efficiently adjusted to a desired size by the user with one or two hands.

Referring to FIG. 8, the strap 44 includes first and second strap ends 98 and 100. The first strap end 98 fixedly secured to the rear of the shell 12, preferably using a second rivot 102. In alternative preferred embodiments, the first end 98 of the strap 44 can be connected to the shell 12 through other conventional fastening means. The strap 44 extends through and operably engages the guide 96 and then extends through the slot 40 within the shell 12. The second strap end 100 includes the tab 54 and a segment 104 of hook type fastening material for releasable attachment to the patch 50. Alternatively, the segment 104 can be another type of conventional fastener. The strap 44 provides an efficient mechanism for quickly and easily grasping, controlling, adjusting and securing the adjustment assembly 16 during use. In particular, movement of the strap 44 results in an adjustment to the guide 96 and a corresponding adjustment of the size of the opening formed by the padding assembly 14 for receiving the user's head. The strap 44 is formed of a flexible, durable material, preferably a generally flat strip of woven fabric. Alternatively, the strap 44 can be formed of other materials, such as for example, a non-woven material, a rope, a cable and combinations thereof and can be formed in alternate shapes. The strap 44 can also be formed of an elastic or a substantially inelastic material.

The guide 96 is a bracket that operably engages the shell 12, the strap 44 and the adjusting member 46 and enables the efficient transfer of force resulting from movement of the strap 44, during adjustment, to the padding assembly 14. The guide 46 has opposing sides 106 and 108 connected by first and second cross members 110 and 111. The first cross-member 110 has a general U-shaped cross-section that defines an adjusting member channel 112 for receiving the adjusting member 46. The first and second cross-members 110 and 111 are spaced from one another to define, in conjunction with the sides 106 and 108, an adjusting slot 114. In alternative preferred embodiments, the guide 96 can be formed in different shapes, with different shaped and sized slots and channels. The guide can also be formed of two or more pieces.

Figure 14:
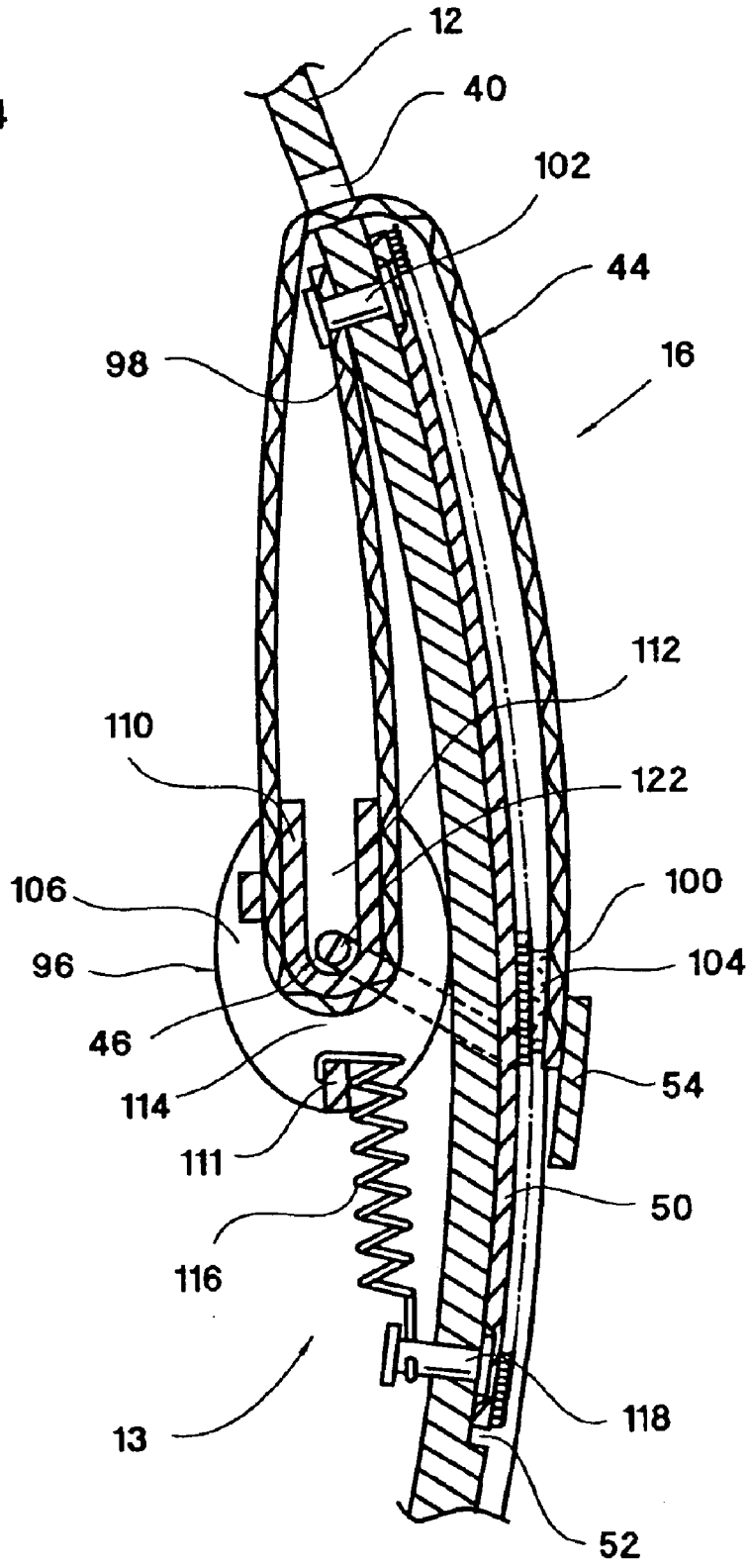
FIG. 14 is a side sectional view of a rear section of the helmet taken along line 8—8 of FIG. 4 illustrating an alternative preferred embodiment for the biasing member.

A biasing member 116 extends at one end through the adjusting slot 114 and connects to the second cross member 111 of the guide 96. The opposite end of the biasing member 116 is connected to shell 12 with a third rivet 118. Alternatively, the biasing member 116 can be connected to the guide 96 and the shell 12 through other conventional connection means. The biasing member 116 is a resilient elastic body, preferably an elastic strap. In alternative preferred embodiments, the biasing member 116 can be formed of other resilient elastic bodies, such as, for example, a spring (see FIG. 14). The biasing member 116 urges the guide 96 into a first position and resists upward movement of the guide 96.

The strap 44 also extends through the adjusting slot 114 of the guide 96. The outer surface of the U-shaped first cross member 110 provides guides the path of travel of the strap 44 along and through the guide 96. The adjusting member 46 is routed through the channel 112 formed by the inner surface of the U-shaped first cross member 110. In alternative preferred embodiments, the first cross member can be formed in other shapes, such as, for example, V-shaped.

Figure 9:
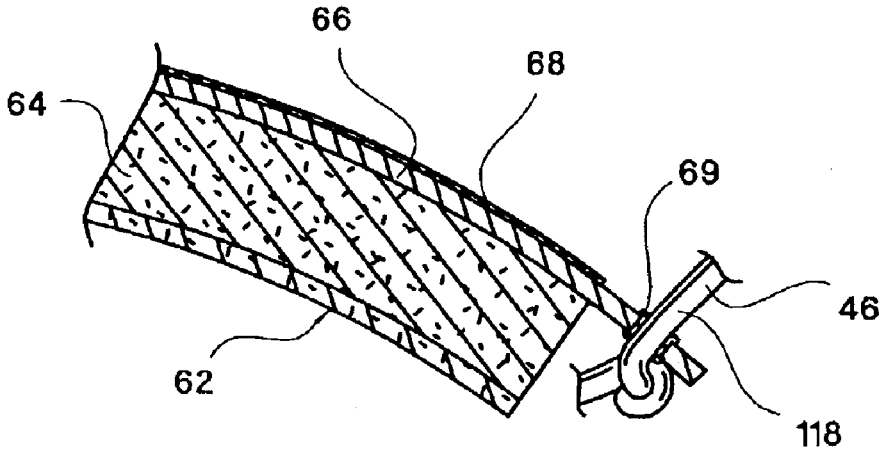
FIG. 9 is bottom sectional view of the padding assembly of the helmet taken along line 9—9 of FIG. 4.

Referring to FIG. 7, the adjusting member 46 is flexible elongate rope having first and second adjusting member ends 118 and 120. The adjusting member 46 converts or transfers the movement or repositioning of the strap 44 into a change in the size of the opening formed by the padding assembly 14. The adjusting member 46 is preferably a single rope-like member. The adjusting member 46 can comprise one or more rope segments, cords, cables, laces, straps or combinations thereof. The first and second adjusting member ends 118 and 120 are fixedly connected to the first and second adjustment points 69 and 71 of the circumferential portion 62 of the padding assembly. Referring to FIG. 9, the connection of the first adjusting member end 118 to the first adjustment point 69 is shown. Referring to FIGS. 7 and 9, the first and second adjusting member ends 118 and 120 are preferably tied to the first and second adjustment points 69 and 71. In alternative preferred embodiments, the ends of the adjusting member 46 can be connected to the padding assembly 14 through other conventional means.

Figure 10:
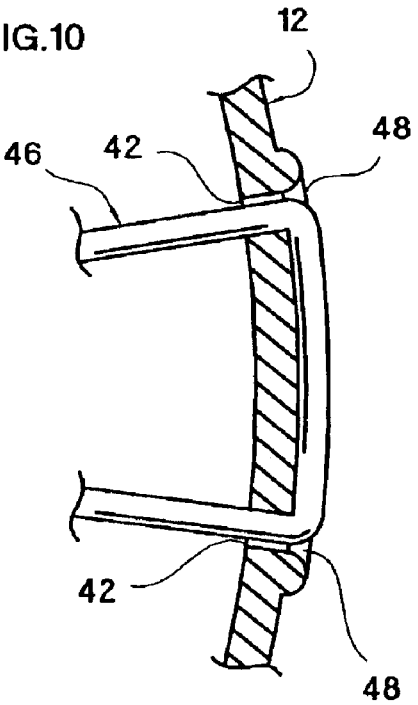
FIG. 10 is bottom sectional view of the helmet taken along line 10—10 of FIG. 4.

Referring to FIGS. 6 and 7, the adjusting member 46 extends from the first and second adjusting member ends 118 and 120 through the channel 88 defined on the back portion 80 of the padding assembly 14. Referring to FIGS. 7 and 2, the adjusting member 46 further extends toward each of the spaced apart pairs of support holes 42 in the shell 12. The spaced apart pairs of support holes 42 enable the adjusting member 46 to thread outside and back inside the shell 12 thereby enabling the shell 12 to serve as a support for the adjusting member 46 at two spaced apart locations on the back of the shell 12. Specifically, referring to FIGS. 2 and 10, the adjusting member 46 threads through one support hole 42 to the outer surface of the shell 12, then extends through along the groove 48 formed in the outer surface of the shell 12 and then extends back into the shell 12 through another support hole 42. Referring to FIGS. 2 and 7, the support holes 42 and groove 48 of the shell 12 redirect the adjusting member 46 as the adjusting member 46 extends through the holes 42 and over the groove 48. The support holes 42 and groove 48 are sized and configured to enable the adjusting member 46 to slide or otherwise move with respect to the shell 12. In alternative preferred embodiments, the pairs of support holes 42 through the shell 12 can be replaced by one or more brackets or other support means positioned on the inner surface of the shell. Referring to FIGS. 7 and 8, the adjusting member 46 then extends from each pair of support holes 42 to the guide 96 where it extends through the U-shaped channel 112 of the guide 96. The portion of the adjusting member 46 at the U-shaped channel of the guide 96 is referred to as the central segment 122.

The helmet 10 is configured to adjust to fit a variety of different head sizes. Preferably the helmet 10 can adjust to fit user's head (or hat) sizes within the range of 6⅛ to 7¾. In a particularly preferred embodiment, the helmet 10 can be configured to adjust to fit user's head (or hat) sizes within the range of 6 ¾ to 7 ¼. Other adjustment size ranges are also contemplated. The helmet 10 can be formed in a youth size and an adult size.

Figure 11:
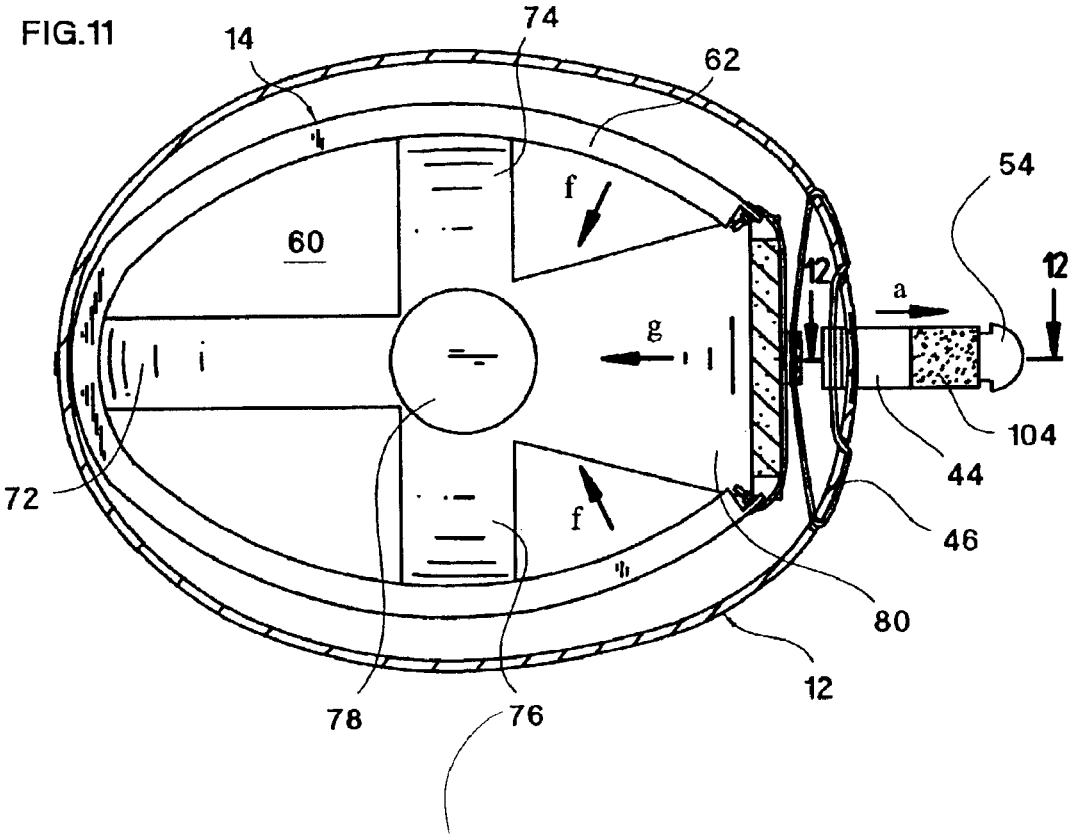
FIG. 11 is a bottom cross-sectional view of the helmet of FIG. 1 with the padding assembly in a reduced size position and the adjustment assembly in an unsecured position.

In operation, the helmet 10 is adjusted in the following member. Referring to FIG. 2, the strap 44 can be grasped by the user at the tab 54 and released from contact with the patch 50. Referring to FIGS. 7 and 11, the strap 44 is shown in a released position ready for adjustment. To tighten the fit of the helmet 10, or otherwise reduce the size of the opening formed by the padding assembly 14 within the shell 12, the user simply grasps the strap 44 with a single hand and moves the strap outward from the shell 12 as shown by arrow a of FIGS. 7 and 12. Movement of the strap 44 outward with respect to the shell 12, forces the guide 96 to move upward in the direction of arrow b of FIGS. 7 and 12. The upward movement of the guide 96 results in the central segment 122 of the adjusting member 46 moving upward thereby causing the adjusting member 46 move upward in the direction of arrows c of FIGS. 7 and 12. Referring to FIGS. 2 and 7, the travel of the adjusting member 46 indicated by the direction of the arrows c also results in the adjusting member 46 moving in the direction of arrows d as the adjusting member 46 changes direction through and along the support holes 42 and the groove 48 of the shell 12. Referring to FIG. 7, two separate segments of the adjusting member 46 slide through the channel 88 of the back portion 80 of the padding assembly 14. This sliding movement results in movement of the adjusting member 46 as shown by arrows e of FIG. 7. The movement of the adjusting member 46 as indicated by arrows d and e of FIG. 7, produces an inward movement of the side portions of the circumferential portion 62 of the padding assembly 14 as shown by arrows f of FIGS. 7 and 11 and a corresponding forward movement of the back portion 80 of the padding assembly 14 as shown by arrow g of FIGS. 7 and 11, thereby resulting in an adjustment of the size of the opening formed by the padding assembly 14.

Figure 12:
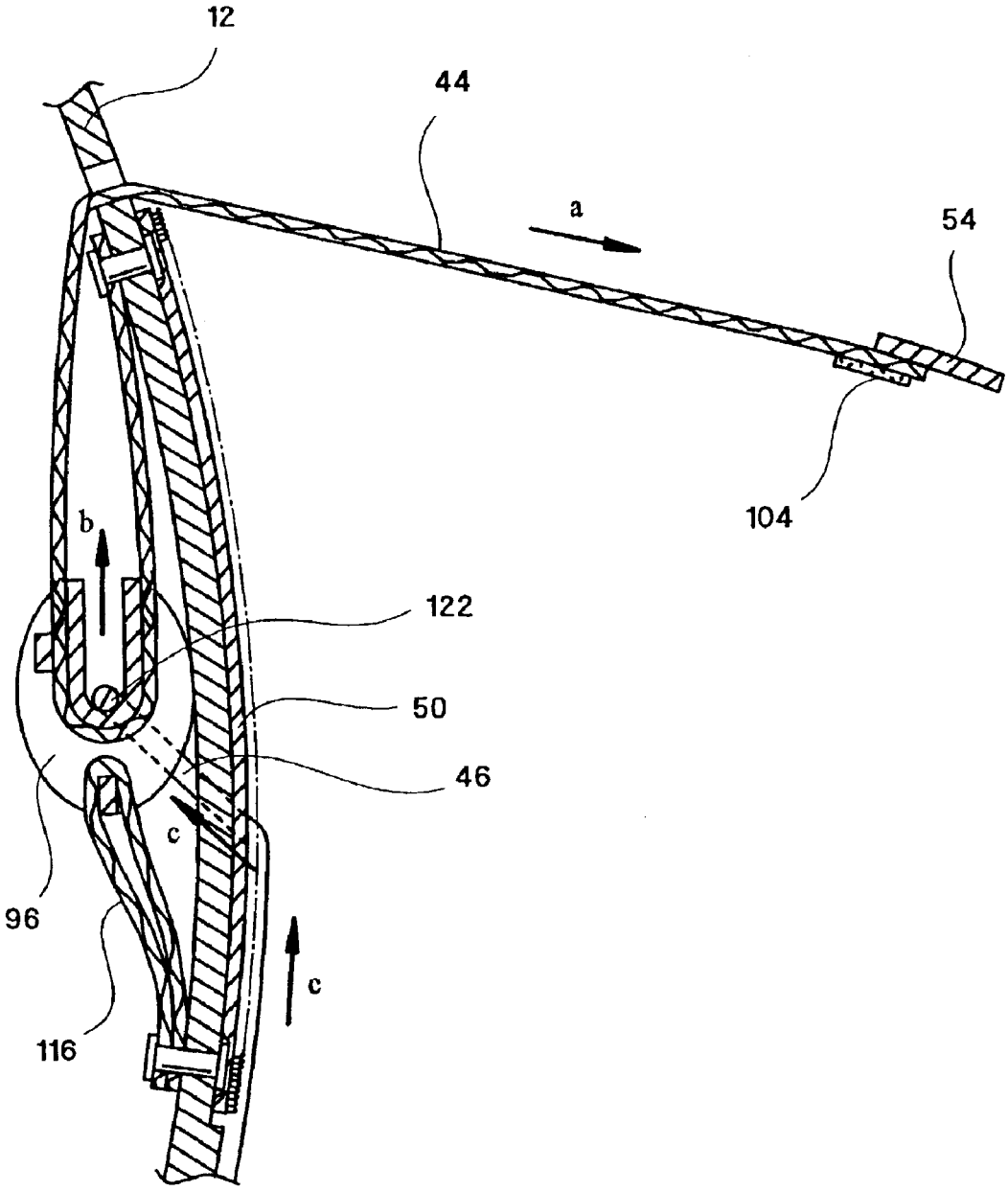
FIG. 12 is side sectional view of the rear section of the helmet taken along line 12—12 of FIG. 11.

Referring to FIGS. 4 and 12, the adjustment of the size of the opening of the padding assembly 14 is further illustrated. In FIG. 4, the padding assembly 14 is shown in a fully open position, or the position with the largest size of the opening of the padding assembly 14. Upon movement of the strap 44 along the direction a away from the shell 12, the adjustment assembly 16 causes the sides of the circumferential portion 62 and the rear portion 80 of the padding assembly 14 to move inward and forward in the direction of the arrows f and g of FIG. 11, respectively, to reduce the size of the opening within the padding assembly 14. The adjustment assembly 16 enables the user to adjust the size of the opening of the padding assembly 14 to any one of a number of desired sizes by simply pulling the strap 44 until the desired opening size of the padding assembly 14 is achieved and then resecuring the strap to the patch 50 on the shell 12 of the helmet 10.

Referring to FIG. 12, the biasing member 116 resists upward movement of the guide 96 and the outward movement of the strap 44 when the strap 44 is pulled away from the shell 12 to reduce the opening in the padding assembly 14. The resistive force created by the biasing member 116 is overcome by the user's pulling adjustment of the strap and the subsequent refastening of the strap 44 to the patch 50.

However, if the user desires to later enlarge the previously reduced opening within the padding assembly 14, the user simply releases the strap 44 from the patch 50 on the shell 12 and then allows the force of the biasing member 116 to retract the strap 44 back within the shell 12 until the desired opening size of the padding assembly 14 is obtained. Referring to FIGS. 7 and 11, this retracting movement of the strap 44 caused by the biasing member 116 lowers the guide 96 and reverses the movement of the adjusting member 46, thereby causing the sides of the circumferential portion 62 of the padding assembly 14 to move outward and the back portion 80 of the padding assembly 14 to move rearward, thereby enlarging the opening of the padding assembly to the desired size or position.

The adjustment assembly 16 of the helmet 10 allows a single user, or other person, to simply, easily, reliably and efficiently adjust the size of the helmet 10 to any one of a desired sizes or positions. This adjustment can be performed with a single hand, wherein the user releases, adjusts and resecures the strap 44 using a single hand. The adjustment of the helmet 10 can also be performed with two hands, wherein the user places one hand on the shell 12 to further support it and uses the second hand to release, adjust and resecure the strap 44. In any event, the adjustment of the helmet 10 does not require a second person to properly perform the adjustment. Additionally, the adjustment of the helmet 10 can be performed quickly and easily from the exterior of the helmet 10 and the adjustment can be performed with the helmet on or off of the user. The user is not required to remove the helmet or to reach within the shell of the helmet in order to accomplish the adjustment. The adjustment assembly 16 is compact, not bulky, and it is light in weight such that it can be easily added to a helmet without significantly affecting the helmet's weight or ease of use. The simply reliable adjustment operation of the helmet enables users of all ages to quickly and easily accomplish the desired adjustment.

In an alternative preferred embodiment, the adjustment assembly can be reconfigured to operate in an opposite manner as described above. In particular, the outward movement of the strap with respect to the shell can cause the opening within the padding assembly to enlarge and vice-versa. In another alternative embodiment, the strap can be replaced with a dial or other type of actuation device. In another alternative preferred embodiment, the adjusting device can be formed without a biasing member. The guide can be connected directly to the shell and the shell can include some type of indexing or detent means to enable discreet movement of the guide in multiple positions with respect to the shell.

Figure 13:
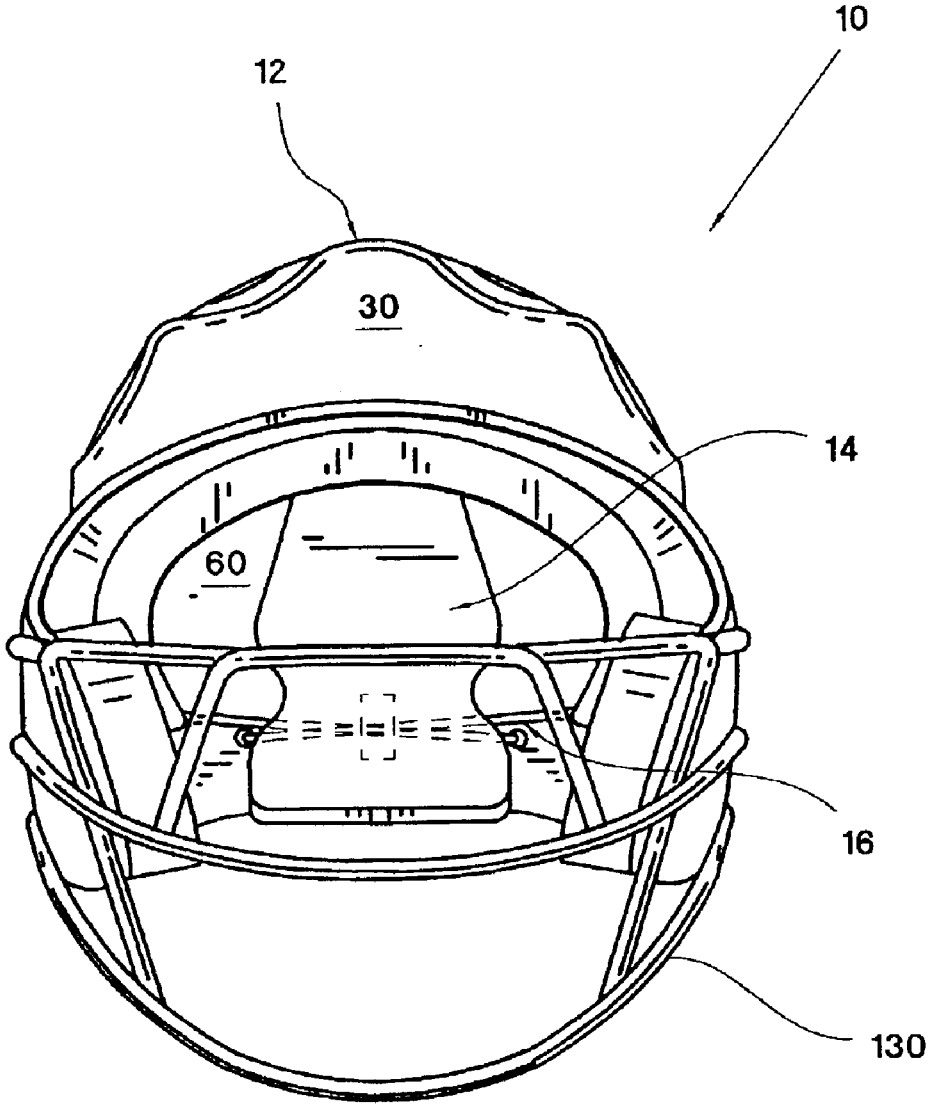
FIG. 13 is a front view of the helmet of FIG. 1 with a face mask.

Referring to FIG. 13, in an alternative preferred embodiment, the helmet 10 can also include a face mask 130 that releasably and matably connects to the shell 12. The face mask 130 is made of a tough durable material preferably a metal. Alternatively, other materials can be used, such as, for example, polycarbonate, ABS, and other composite materials.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. An adjustable sports helmet configured for protecting a user's head, the helmet comprising:

a shell having an inner surface and an outer surface;

a head support assembly coupled to the inner surface of the shell, the support assembly having at least two spaced apart adjustment points; and an adjustment assembly including a guide, a strap and at least one adjusting member, the guide being operably coupled to the inner surface of the shell, the strap having a first portion connected to the guide and a second portion releasably connected to the shell, the adjusting member operably engaged to the guide and connected to the adjustment points of the support assembly.

2. The helmet of claim 1 wherein the head support assembly includes a generally circumferential support portion.

3. The helmet of claim 2, wherein the head support assembly includes a plurality of pads.

4. The helmet of claim 1 wherein the head support assembly is configured to conform to a portion of the user's head, and wherein the adjustment points of the head support assembly move with respect to the shell upon adjustment of the strap.

5. The helmet of claim 1 wherein the second portion of the strap is releasably connected to the outer surface of the shell.

6. The helmet of claim 1 wherein the shell includes a strap slot, and wherein the strap extends through the strap slot.

7. The helmet of claim 6 wherein the strap slot is centrally positioned on the shell.

8. The helmet of claim 1 wherein the second portion of the strap is releasably connected to the shell through a fastener.

9. The helmet of claim 1 wherein the adjustment assembly further comprises a biasing member, and wherein the biasing member is connected to the inner surface of the shell and the guide.

10. The helmet of claim 9 wherein the biasing member is selected from the group consisting of an elastic strap and a spring.

11. The helmet of claim 1 wherein the at least two adjustment points of the padding include first, second and third adjustment points, wherein the first and second adjustment points are connected to the separate ends of the adjusting member, and wherein the third adjustment point is operably engaged with the adjusting member.

12. The helmet of claim 1, wherein the adjusting member is selected from the group consisting of one or more cords, cables, laces, adjusting straps and combinations thereof.

13. The helmet of claim 1, wherein the helmet is selected from the group consisting of a batting helmet, a motorcycle helmet, a lacrosse helmet, a football helmet, a bicycle helmet, and a hockey helmet.

14. An adjustable batting helmet configured for protecting a batter's head, the helmet comprising:

a shell having an inner surface and an outer surface, the shell including a through wall slot;

a padding assembly coupled to the inner surface of the shell; and an adjustment assembly operably connected to the padding assembly, the adjustment assembly including a single strap having an inner portion and an outer portion, the strap extending through the slot, the outer portion releasably connecting to the outer surface of the shell, the outer portion of the strap being only one strap segment and being configured for grasping and adjustment by the batter with only one hand to enable the batter to adjust the padding assembly within the shell.

15. The helmet of claim 14 wherein the padding assembly has at least first and second spaced apart adjustment points, and wherein the adjustment assembly is connected to the first and second spaced apart adjustment points.

16. The helmet of claim 14 wherein the shell includes a central portion extending from the front to the rear of the helmet, and wherein the slot is positioned at the central portion of the shell.

17. The helmet of claim 16 wherein the slot is also positioned at a rear portion of the shell.

18. The helmet of claim 14 wherein the strap is releasably connected to the shell through a fastener.

19. The helmet of claim 14, wherein the strap includes a tab for facilitating the release and adjustment of the strap with respect to the shell.

20. The helmet of claim 19 wherein the tab includes indicia selected the group consisting of graphical indicia, alphanumeric indicia, and combinations thereof.

21. The helmet of claim 14, wherein the padding assembly includes first and second side portions, and a rear portion, and wherein the adjustment assembly operably engages the first and second side portions and the rear portions thereby enabling the helmet to be adjusted to fit a wide range of batter's head sizes.

22. The helmet of claim 21, wherein the adjustment assembly is configured to adjust the position of the padding assembly to fit batter's head sizes within the range of 6⅛ to 7¾.

23. The helmet of claim 22, wherein the adjustment assembly is configured to adjust the position of the padding assembly to fit batter's head sizes ranging from 6¾ to 7¼.

24. The helmet of claim 14 wherein the shell further includes at least one ear protector and a bill.

25. The helmet of claim 24, wherein the helmet further comprises a face mask matably coupled to the shell.

26. The helmet of claim 14, wherein the shell further includes a plurality of ventilation holes spaced about an upper, front region of the shell.

27. The helmet of claim 14, wherein the strap is releasably connected to the outer surface of the shell.

28. An adjustable batting helmet configured for protecting a batter's head, the helmet comprising:

a shell having an inner surface and an outer surface and including an aperture;

a padding assembly coupled to the inner surface of the shell, the padding assembly being configured to generally conform to the batter's head, the padding assembly having at least first and second spaced apart adjustment points;

an adjustment assembly positioned within the shell and connected to the padding at the first and second spaced apart adjustment points; and an actuator extending through the aperture of the shell and having first and second portions, the first portion operably connected to the adjustment assembly within the shell and a second portion selectably positionable from the outer surface of the shell to selectably adjust the padding assembly, the adjustment assembly further including a biasing member connected to the inner surface of the shell, the biasing member being selected from the group consisting of an elastic strap and a spring.

29. The helmet of claim 28, wherein the padding assembly includes first and second side portions and a rear portion, and wherein the first and second adjustment points are positioned on the first and second side portions respectively.

30. The helmet of claim 29, wherein the adjustment assembly is connected to the first and second side portions such that adjustment of the actuator results in movement of the first and second side portions with respect to the shell.

31. The helmet of claim 29, wherein the adjustment assembly is connected to the first and second side portions and the adjustment assembly is operably coupled to the rear portion such that adjustment of the actuator results in movement of the first and second side portions and the rear portion with respect to the shell.

32. The helmet of claim 28, wherein the padding assembly is connected to the inner surface of the shell at front and top locations of the inner surface of the shell.

33. The helmet of claim 28, wherein the shell further includes a plurality of ventilation holes spaced about an upper, front region of the shell.

34. The helmet of claim 28, wherein the shell includes a longitudinally extending central region extending from the front to the back of the shell, and wherein the aperture is positioned within the central region.

35. The helmet of claim 28, wherein the actuator is selected from group consisting of a strap, a cable, a wire, a rod, a wire and combinations thereof.

36. The helmet of claim 35 wherein the actuator is releasably connected to the outer surface of the shell in one of a plurality of positions.

37. The helmet of claim 28, further comprises a face mask matably coupled to the shell.

38. A batting helmet configured for protecting a batter's head, the helmet comprising:

a shell including a crown, a circumferentially extending side wall, and a bill, the shell having an inner and outer surface, the outer surface of the helmet having first and second regions, the first region having a generally smooth texture and the second region having a slightly roughened texture, the side wall having front and rear portions, the first region generally encompassing the front portion of the side wall, the second region extending over at least a portion of the rear portion, the bill extending from the front portion of the side wall; and a padding assembly coupled to the shell.

39. The helmet of claim 38, wherein the shell further includes a plurality of ventilation holes spaced about an upper, front portion of the crown of the shell.

40. The helmet of claim 38, further comprises a face mask matably coupled to the shell.

41. The helmet of claim 38, further comprising an adjustment assembly coupled to the padding assembly and to the shell.

* * * * *